US005500724A

United States Patent [19]

Campbell et al.

[11] Patent Number: 5,500,724

[45] Date of Patent: Mar. 19, 1996

[54] PHOTOCONDUCTOR FOR ABRASION IN LIQUID SYSTEMS

[75] Inventors: Alan S. Campbell; Donald L. Elbert; William C. McCornack; Eric L. Ziercher, all of Lexington, Ky.

[73] Assignee: Lexmark International, Inc., Greenwich, Conn.

[21] Appl. No.: 409,622

[22] Filed: Mar. 23, 1995

Related U.S. Application Data

[63] Continuation of Ser. No. 239,803, May 9, 1994, abandoned.

[51] Int. Cl.[6] ..... G03G 21/00

[52] U.S. Cl. ..... 355/297; 355/256

[58] Field of Search ..... 355/296, 299, 355/219, 301, 256, 215, 297; 118/652

[56] References Cited

U.S. PATENT DOCUMENTS

| | | | |
|---|---|---|---|
| 3,776,631 | 12/1973 | Mammino | 355/296 |
| 3,815,295 | 6/1974 | Lanker | 451/49 |
| 4,007,983 | 2/1977 | Knieser | 355/299 X |
| 4,089,683 | 5/1978 | Knieser | 355/299 X |
| 4,420,244 | 12/1983 | Landa | 355/256 X |
| 5,179,416 | 1/1993 | Ku et al. | 355/297 |
| 5,187,525 | 2/1993 | Fushimi et al. | 355/215 |
| 5,363,181 | 11/1994 | Linblad et al. | 355/299 |

FOREIGN PATENT DOCUMENTS

| | | | |
|---|---|---|---|
| 2609191 | 6/1988 | France | G03G 21/00 |
| 57-176086 | 10/1982 | Japan | 355/219 |
| 58-72980 | 5/1983 | Japan | G03G 21/00 |
| 59-46672 | 3/1984 | Japan | G03G 21/00 |
| 61-144680 | 7/1986 | Japan | 355/299 |
| 1-20586 | 1/1989 | Japan | 355/299 |
| 1-020586 | 1/1989 | Japan | 355/299 |
| 1-161280 | 6/1989 | Japan | 355/299 |
| 3-002887 | 1/1991 | Japan | 355/299 |
| 3-284784 | 12/1991 | Japan | 355/299 |
| 4-051075 | 2/1992 | Japan | 355/299 |
| 4-317093 | 11/1992 | Japan | 355/299 |
| 1528586 | 10/1978 | United Kingdom | G03G 5/04 |
| 2034201 | 6/1980 | United Kingdom | 355/296 |
| 2167199 | 5/1986 | United Kingdom | G03B 5/04 |

OTHER PUBLICATIONS

Japanese Abstract 1196072, Aug. 1989, Canon.

*Primary Examiner*—A. T. Grimley
*Assistant Examiner*—Shuk Y. Lee
*Attorney, Agent, or Firm*—John A. Brady

[57] ABSTRACT

In a liquid toner electrophotographic printer (1), an abrasive blade (5), located between the cleaning station (19) and the charging station (9) disturbs the outer, photoconductive surface of drum (3) to continuously rejuvenate that surface. The abrasion merely disturbs the surface and may be accomplished by alternative abrasive mechanisms.

3 Claims, 2 Drawing Sheets

PHOTOCONDUCTOR FOR ABRASION IN LIQUID SYSTEMS

This application is a continuation of application Ser. No. 08/239,803, filed May 9, 1994, now abandoned.

TECHNICAL FIELD

This invention relates to imaging employing a photosensitive element with liquid toner. More specifically, this invention relates to the treatment of the photosensitive element with abrasion in such an imaging apparatus.

BACKGROUND OF THE INVENTION

In some electrophotographic systems having organic photoconductor elements, a loss of resolution in print quality occurs over the desired period of use because of a modification of the outer surface of the photosensitive element. In dry electrophotographic systems the surface of a photoconductor tends to become contaminated with materials that reduce the performance of the photoconductor and limit its useful life. The life of such a photoconductor is extended by providing an abrasive toner mix which causes the surface of the photoconductor to slowly abrade away over the intended period of use. This abrasion process cleans the photoconductor surface and keeps the surface fresh. Japanese patent application 1196072 published Aug. 7, 1994, assigned to Canon Corp., is understood to be directed to such intentional abrasion in a dry toning system.

In liquid toning electrophotographic systems the carrier fluid is typically an oil which lubricates the surface and provides a protective film which decreases the amount of abrasion that the photoconductor experiences in the imaging process. Also, since the electrophotographic process requires the use of elevated temperatures to assist in transferring the toner from the photoconductor, the photoconductor must have a high glass transition temperature (Tg) in order to function properly. The high Tg results in organic photconductive materials which are more rigid and inflexible, and therefore have more resistance to abrasion. Similarly, a photoconductor subject to liquid developer must have resistance to the solvent action of the developer.

U.S. Pat. No. 4,420,244 to Landa employs a liquid toner in which hard particles are included in the toner as spacers. Abrasion from these particles is recognized and is considered undesirable.

DISCLOSURE OF THE INVENTION

In accordance with this invention it has been found that abrasion in some liquid electrophotographic imaging systems is helpful to extend the useful life of the photoconductor. In order to have a controlled abrasion which does not affect the imaging operation and is not affected by the lubricating action of the liquid toner, a mechanical abrasion element or system employing abrasive particles is located between a cleaning station the charging station.

BEST MODE FOR CARRYING OUT THE INVENTION

Figure 1:
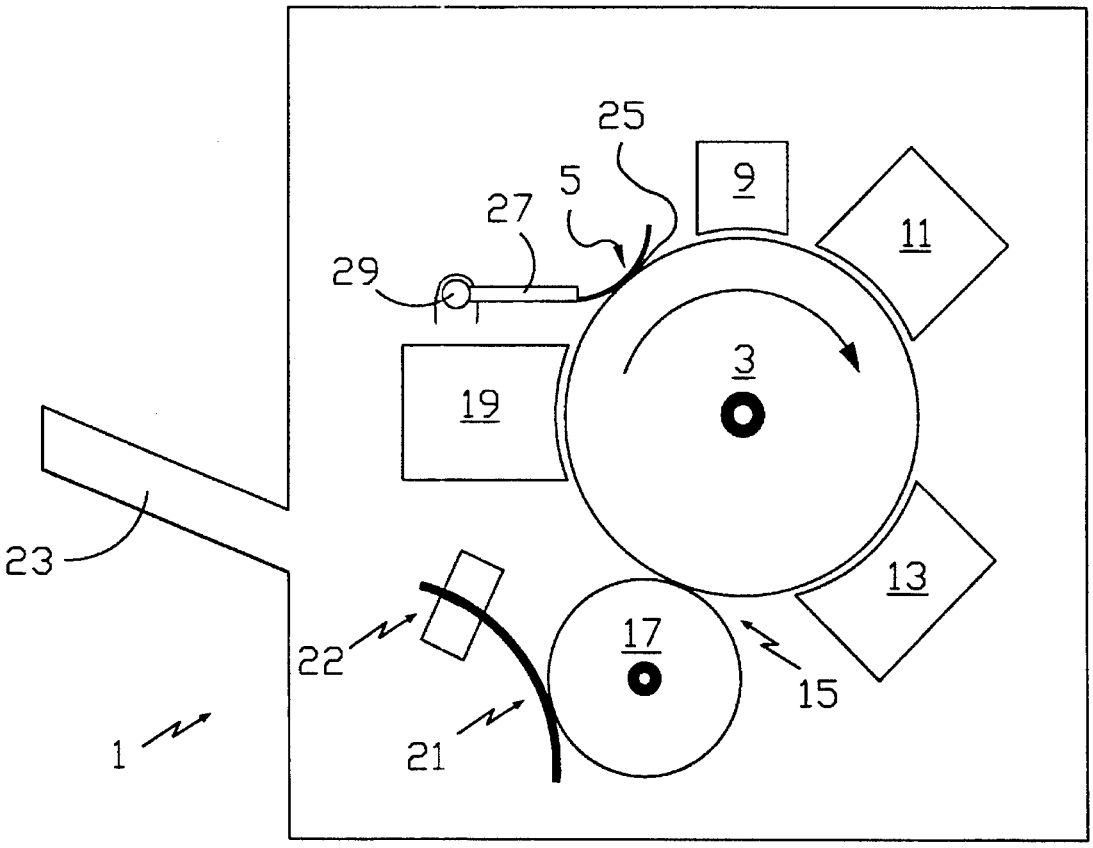
FIG. 1 is illustrative of a first abrading system and FIG. 2 is illustrative of an alternative abrading system.

The drawing illustrates and electrophotographic imaging apparatus 1, such as a laser printer having a photoconductive drum 3 of organic surface, such as a polycarbonate or polyestercarbonate binder with charge transporting additives, as may be essentially conventional. Abrasion is accomplished by rubbing the outer surface of photoconductive drum 3 with an abrasive member 5 (FIG. 1) or 7 (FIG. 2). Abrasive members 5 and 7 are separate from the toner or other operative members such as a charge roller, photoconductor squeegee, intermediate transfer member or other member which contacts drum 3, thereby permitting the operation of each to be unaffected by the abrasion step.

Positioned at stationary locations around the drum are certain members which may be entirely conventional with respect to this invention and are therefore shown illustratively. Drum 3 moves clockwise in the drawing to bring a location on the surface of drum 3 to a charging station 9; then to a laser imaging station 11 positioned past the charging station 9 which applies light in an image pattern to the charged surface of drum, thereby discharging drum 3 in the pattern of that image; then to a liquid toner developing station 13 positioned past imaging station 11; then to a transfer station 15 positioned past developing station 13 in which the toned imaged is transferred to an intermediate transfer member 17; and then to a cleaning station 19, positioned past the transfer station 15. The image is subsequently transferred to paper 21 or other final substrate, fixed by heat at a fixing station 22, and ultimately delivered out of printer 1 to a tray 23 for access to an operator of printer 1.

Figure 2:
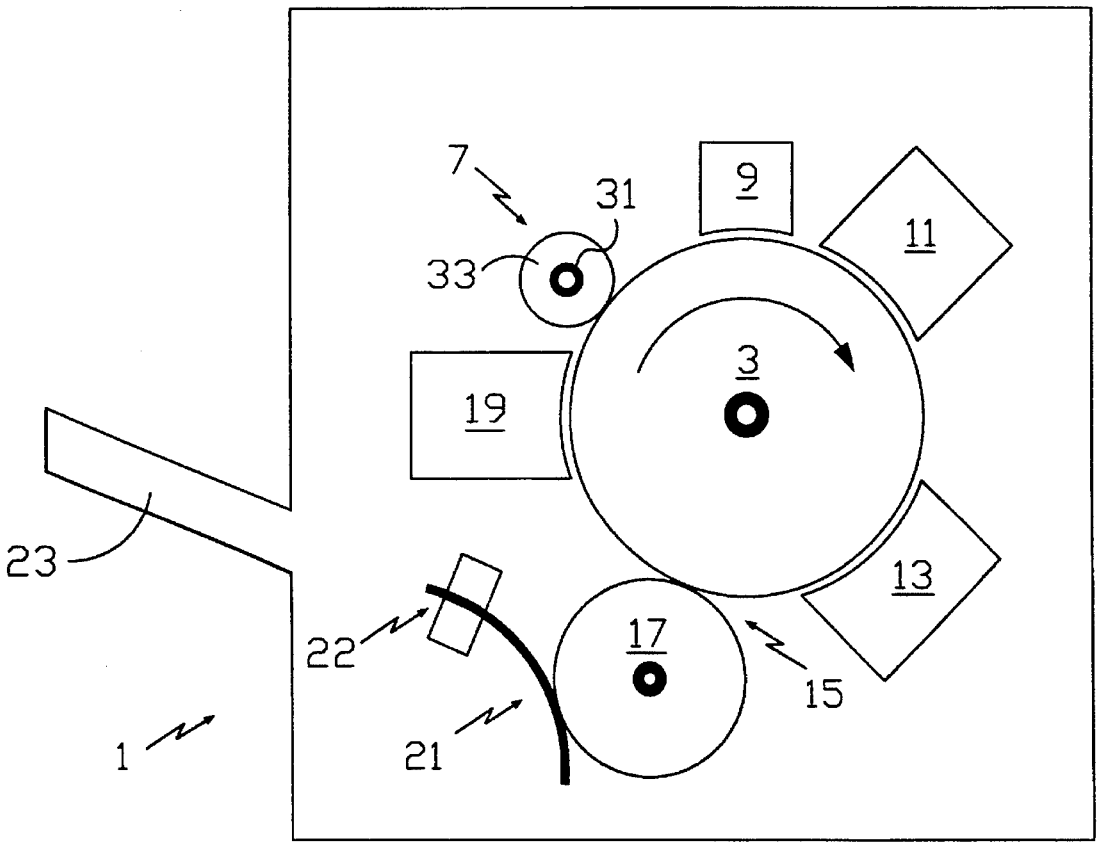

In the FIG. 1 embodiment member 5 is a resilient blade 2 mm thick urethane element with 600 to 800 grit sand paper 25 held by adhesive to the surface facing drum 3. Blade 5 is flexed against drum 3 to provide firm contact. Blade 5 is mounted to a bracket 27 which is supported by a pivot 29. A torque is provided around pivot 29, as by a spring (not shown) to produce a force of 100 grams/cm of longitudinal engagement at the point of engagement with drum 3. (A typical length of drum 3 is 25 cm; therefore the foregoing loading typically is 2500 grams.)

The abrasion apparatus of FIG. 1 may be so closely positioned with respect to cleaning station 19 as to be in its housing. However, cleaning of station 19 has been substantially accomplished on a surface of drum 3 and then that surface of drum 3 encounters blade 5. The surface of drum 3 at blade 5 is therefore substantially dry and cleaned of loose particles, which permits abrasion to be consistent and predictable over a long period.

FIG. 2 is an alternative embodiment which uses an abrasive roller 7 instead of blade 5. Roller 7 may be formed with a metal shaft 31 supporting a 3 mm thick rubber 33 of 40 Shore A hardness with embedded grit on the surface. Rubber 33 provides compliance needed to maintain uniform loading along the surface of drum 3. Roller 7 is rotated in a direction opposite to the direction of rotation of the surface of photoconductor 3 which it contacts. Roller 7 tends to carry away debris, which can then be collected if desired by cleaning the surface of roller 7 in any conventional manner.

Operation of the abrasive members 5 and 7 is just sufficient to physically disturb the outer boundary surface of the drum 3. Although that surface is gradually removed by the action, each pass of photoconductor 3 from cleaning station 19 to charging station 9 is characterized by a rearrangement of the outer boundary surface of the photoconductor drum 3, and consequent rejuvenation of the photoconductive effect of drum 3, not by noticeable roughness of the outer surface of drum 3.

Other alternative within the spirit and scope of this invention can be anticipated. Abrasion between the cleaning station 17 and the charging station 9 permits the abrasion action to occur without influencing the imaging mechanisms themselves.

We claim:

1. An imaging apparatus comprising an endless member having a photosensitive surface ending at an outer boundary, a charging station positioned at a first location to charge said photosensitive surface as said photosensitive surface is moved, an imaging station positioned at a second location past said first location to discharge said photosensitive surface in an image pattern as said photosensitive surface is moved, a liquid toning station positioned at a third location past said second location to develop said image on said photosensitive member with liquid toner, a transfer station positioned at a fourth location past said third location to transfer said toned image from said photosensitive surface for ultimate transfer of said toned image to paper or other substrate for delivery out of said imaging apparatus, a cleaning station positioned at a fifth location past said fourth location, said cleaning station substantially drying and smoothing said photosensitive surface by removing liquid and loose particles from said photosensitive surface, and an abrasive particles containing abrasive member positioned between said fifth location and said first location and pressing said outer boundary of said photosensitive surface sufficient for said abrasive particles to physically disturb said photosensitive surface while not roughening said photosensitive surface.

2. The imaging apparatus as in claim 1 in which said abrasive member is a resilient blade having a surface contacting said outer boundary with said particles equivalent to 600 to 800 grit sand paper.

3. The imaging apparatus as in claim 1 in which said abrasive member is a resilient roller with said particles being embedded grit and mounted to turn at a velocity relative to the movement of said outer boundary to rub said outer boundary where said abrasive roller presses said outer boundary.

* * * * *